US006406256B1

(12) United States Patent
Marx

(10) Patent No.: US 6,406,256 B1
(45) Date of Patent: Jun. 18, 2002

(54) DEVICE AND METHOD FOR THE CONTROLLED SETTING OF THE GAP BETWEEN THE STATOR ARRANGEMENT AND ROTOR ARRANGEMENT OF A TURBOMACHINE

(75) Inventor: Peter Marx, Baden (CH)

(73) Assignee: Alstom, Paris (FR)

( * ) Notice: Subject to any disclaimer, the term of this patent is extended or adjusted under 35 U.S.C. 154(b) by 0 days.

(21) Appl. No.: 09/638,015

(22) Filed: Aug. 14, 2000

(30) Foreign Application Priority Data

Aug. 12, 1999 (DE) ..... 199 38 274

(51) Int. Cl.[7] ..... F01D 25/26
(52) U.S. Cl. ..... 415/138; 415/173.1
(58) Field of Search ..... 415/138, 173.1, 415/173.3, 196, 213.1, 135

(56) References Cited

U.S. PATENT DOCUMENTS 4,642,024 A 2/1987 Weidner
4,759,687 A * 7/1988 Miraucourt et al. ..... 415/138
5,211,534 A * 5/1993 Catlow ..... 415/173.3
5,228,828 A 7/1993 Damlis et al.
5,333,995 A * 8/1994 Jacobs et al. ..... 415/173.3
5,988,975 A * 11/1999 Pizzi ..... 415/173.1

* cited by examiner

*Primary Examiner*—Edward K. Look
*Assistant Examiner*—James M McAleenan
(74) *Attorney, Agent, or Firm*—Burns, Doane, Swecker & Mathis, L.L.P.

(57) ABSTRACT

A device and a method are described for the controlled setting of the gap between the shroud arrangement and rotor arrangement of a turbomachine, the shroud arrangement of which has a shroud carrier and at least one shroud segment connectable to the shroud carrier via at least two holding webs and the rotor arrangement of which provides at least one moving blade row rotatable about an axis of rotation and having a plurality of individual moving blades, the movable blade ends of which are located opposite the shroud segment and with the latter enclose a radial gap.

14 Claims, 4 Drawing Sheets

Figure 1:
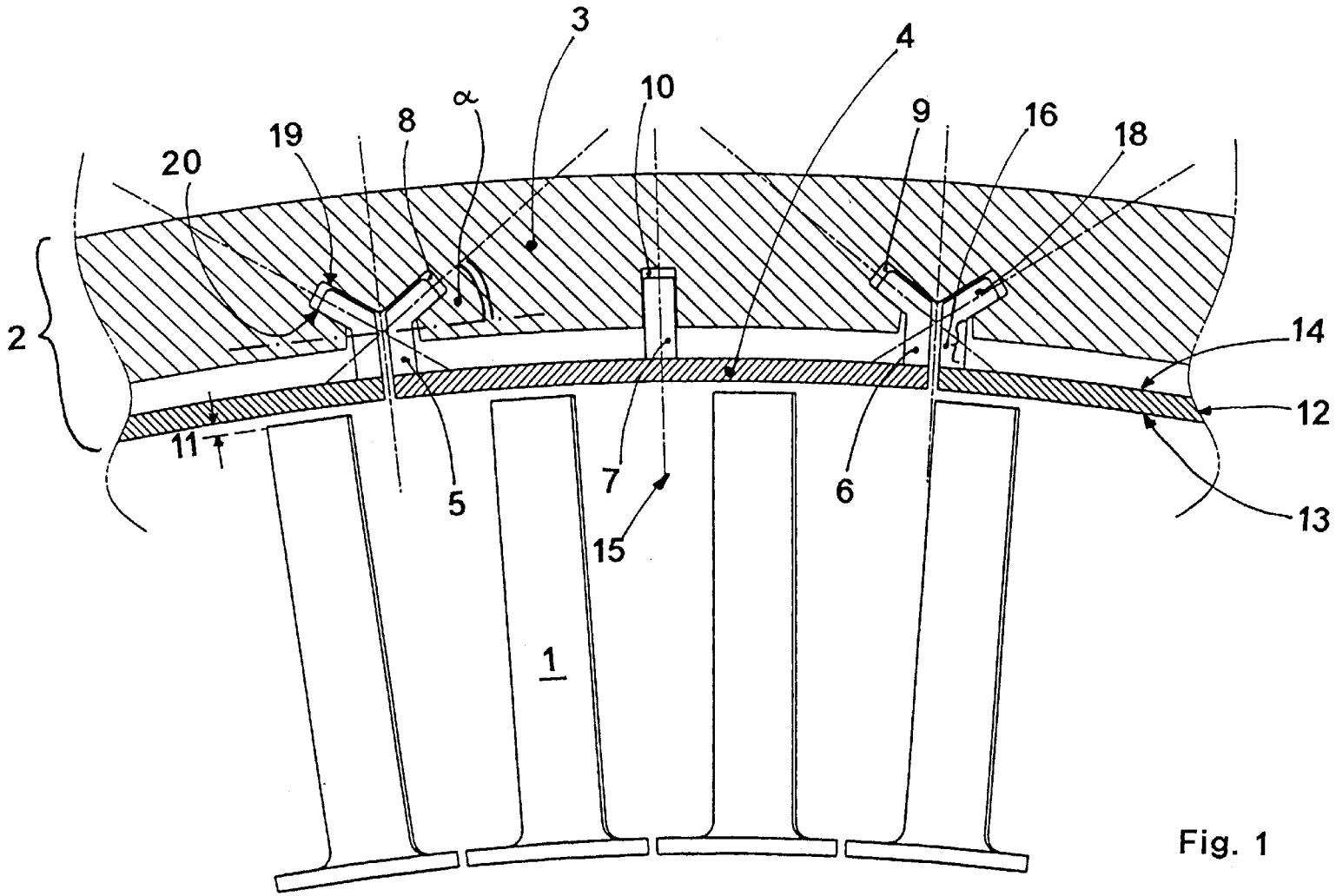

DEVICE AND METHOD FOR THE CONTROLLED SETTING OF THE GAP BETWEEN THE STATOR ARRANGEMENT AND ROTOR ARRANGEMENT OF A TURBOMACHINE

This application claims priority under 35 U.S.C. §§119 and/or 365 to Appln. No. 199 38 274.3 filed in Germany on Aug. 12, 1999; the entire content of which is hereby incorporated by reference.

BACKGROUND OF THE INVENTION

1. Field of the Invention

The invention relates to a device and to a method for the controlled setting of the gap between the stator arrangement and rotor arrangement of a turbomachine, the stator arrangement of which has a stator carrier and at least one stator segment which is connectable to the stator carrier via at least two holding webs and the rotor arrangement of which provides at least one moving blade row rotatable about an axis of rotation and having a multiplicity of individual moving blades, the moving blade ends of which are located opposite the stator segment and with the latter enclose a radial gap.

2. Description of the Related Art

Turbomachines of the generic type designated above serve primarily, on the one hand, for the controlled compression of gases, as is the case in compressor stages in turbo systems, and, on the other hand, for the controlled expansion of highly compressed and fast-flowing media for driving gas turbines which are used in a way known per se for energy generation. The other aspect of the turbomachine is the increase in their efficiencies and, along with this, a highly efficient conversion of energy by means of the working medium passing through the turbomachine. Loss mechanisms occurring both during the compression of the working media to be compressed and when turbines are being driven are to be reduced or avoided completely by technical means.

In this respect, it is expedient, in particular, to keep the radial gap formed in thermal turbomachines between the rotating and the stationary system components as small as possible, in order to reduce the so-called hydraulic losses which consist of mass flows, albeit small, of the working medium passing through the turbomachine, without at the same time participating in the desired energy conversion. Hydraulic losses thus constitute loss mechanisms which may considerably reduce the efficiency of turbomachines.

The particular problem in the reduction of hydraulic losses is, on the one hand, the need for discrete spacing between the stationary and rotating components of a turbomachine, in order to ensure that the rotor arrangement runs freely; on the other hand, it is expedient, for the reasons mentioned, to keep this interspace as small as humanly possible, this being made more difficult by the criterion that the system components of a turbomachine be capable of expanding under thermal load, with the result that, while a turbomachine is in operation, the relative positions of the individual components change due to a varying thermal expansion behavior. This makes it difficult, moreover, to achieve the least possible gap dimensioning for the entire operating range of a turbomachine which, depending on the type of turbomachine, is exposed to a wide temperature spectrum. Thus, as a result of the centrifugal forces acting on the rotating components, these undergo more rapid expansion, which would basically lead to a reduction of the gap, than the complex thermally insulated components of the stator which experience slower heating and, in a thermally steady operating state, contribute by expansion to an increase in the gap dimension.

Both active and passive measures are known for controlling or influencing the gap dimension, the passive precautions being looked at in more detail below, especially since active control precautions implemented by mechanical setting systems for gap control have high complexity and are suitable only to a limited extent for robust machines subjected to high thermal stress, such as, for example, gas turbine plants.

One possibility for the passive implementation of gap control is the controlled optimization of material combinations with specifically selected coefficients of thermal expansion, which brings about thermal expansion in all the plant components defining the gap, as a result of which the gap, on the one hand, assumes a minimum size and, on the other hand, maintains this minimum gap width over the entire operating range, that is to say temperature range of turbomachines.

Due to the highly complex configuration of known turbomachines, there are very limited possibilities for the choice of any desired material combinations for stator and rotor components in order to improve the thermal behavior. Although the choice of material may be made, taking into account the problem of gap width, it has not been possible hitherto to achieve a satisfactory reduction in the gap dimension simply by the choice of material combination alone.

Another possibility for keeping the gap dimension small is to allow for abrasive surface actions on stator and rotor components. In this case, the mutually opposite surfaces which almost touch one another are provided with abrasive surface coatings which, when the turbomachine is in operation, are stripped off in a controlled manner, by being deliberately ground off or down, and thus lead to an optimized gap.

However, after a single operating cycle of the turbomachine, the gap formed as a result of abrasive action has an optimized maximum gap width which, however, cannot be reduced again.

Finally, design measures for a uniform expansion of the rotor components and stator components of a turbomachine are also possible, but these all entail considerable extra outlay in design terms and, moreover, are not suitable for robust gas turbine use with long-term stability.

SUMMARY OF THE INVENTION

The object on which the invention is based is to specify a device for the controlled setting of the gap between the stator arrangement and rotor arrangement of a turbomachine, the stator arrangement of which has a stator carrier and at least one stator segment connectable to the stator carrier via at least two holding webs and the rotor arrangement of which provides at least one moving blade row rotatable about an axis of rotation and having a multiplicity of individual moving blades, the moving blade ends of which are located opposite the stator segment and with the latter enclose a radial gap, and to develop said device in such a way that, irrespective of the operating state of the turbomachine, the gap has the smallest possible gap width which is established without any active regulation. The mechanical design measures to be taken in this case are to be implemented simply and cost-effectively and are to satisfy the requirements for robust use with long-term stability, for example in a gas turbine which is in steady-state operation. Moreover, a method is to be specified, by means of which an optimum reduced gap width setting within a turbomachine between the stator arrangement and rotor arrangement is possible without the use of active control and regulating mechanisms.

The device according to the invention has at least one stator segment, on which are arranged, spaced from one another, two holding webs which engage at least partially into countercontours within the stator carrier. At least one holding web has a holding web portion which engages into the countercontour of the stator carrier and which provides a longitudinal extent, the direction of which limits, with a plane containing the axis of rotation and oriented orthogonally to the radial longitudinal extent of that moving blade which with the stator segment encloses the gap, an angle a to which the following applies:

$0° < \alpha < 90°$ or $90° < \alpha < 180°$.

Due to the inherent heating of the stator segment directly exposed to the hot combustion gases when the turbomachine is in operation, said stator segment experiences a longitudinal expansion which, however, because of the two holding webs engaging into the countercontours of the stator carrier, cannot develop entirely without resistance. The stator segment can nevertheless expand by a specific amount due to t heating and to the given coefficient of thermal expansion. Since the holding web portion running at an inclination is mounted so as to be moveable relative to its countercontour provided in the stator carrier, an elongation of the stator segment parallel to its extent becomes possible. The movement relative to the stator carrier takes place because a different longitudinal expansion of the connected components is established, which is to be attributed to different temperatures and coefficients of expansion.

As a result of the positively guided movement of the holding web portion guided in the countercontour at an inclination to the axis of rotation or at an inclination to a plane containing the axis of rotation, the thermal expansion of material of the stator segment causes the surface of the latter to be spaced from the stator carrier, with the result that the gap dimension between the stator segment and a turbine blade located opposite the latter is reduced. After the appropriate cooling of the plant components, a corresponding reduction in length of the stator segment leads to a reversible movement relative to the stator carrier, this entailing a variation in the gap width.

With the aid of the measure according to the invention, it is possible, by simple design means, to implement a reversible minimum gap width adaption during the entire operation of a turbomachine.

The above-specified angle limitation of between $0° < \alpha < 90°$ is to be provided insofar as the stator carrier is capable of expanding more slowly than the stator segment. In the opposite case, in which the stator expands more quickly than the stator segment during transient operating behavior, an angle $\alpha$ of between $90° < \alpha < 180°$ must be selected.

Figure 2:
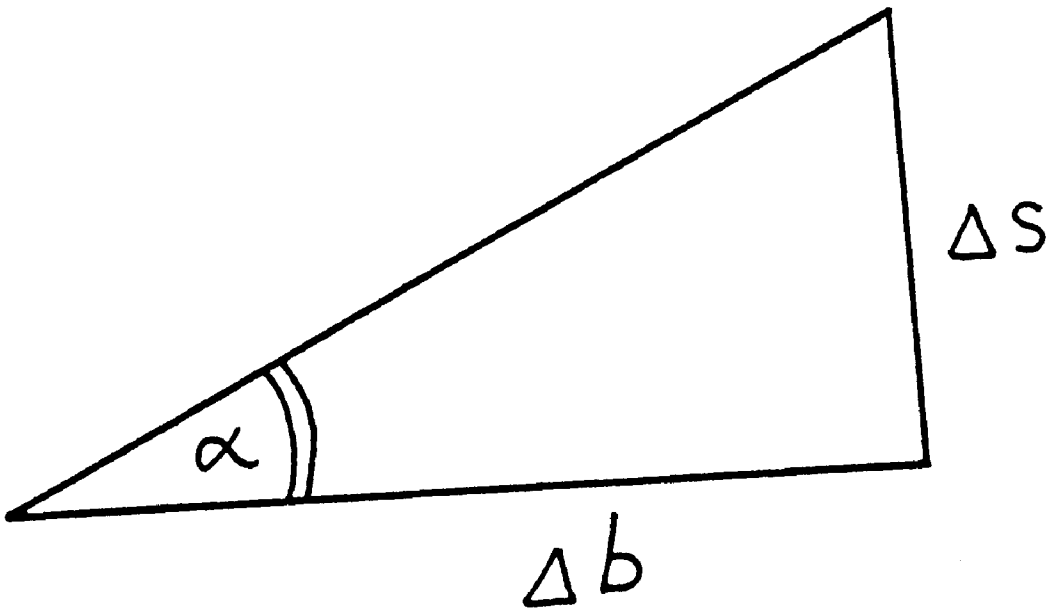
Figure 3:
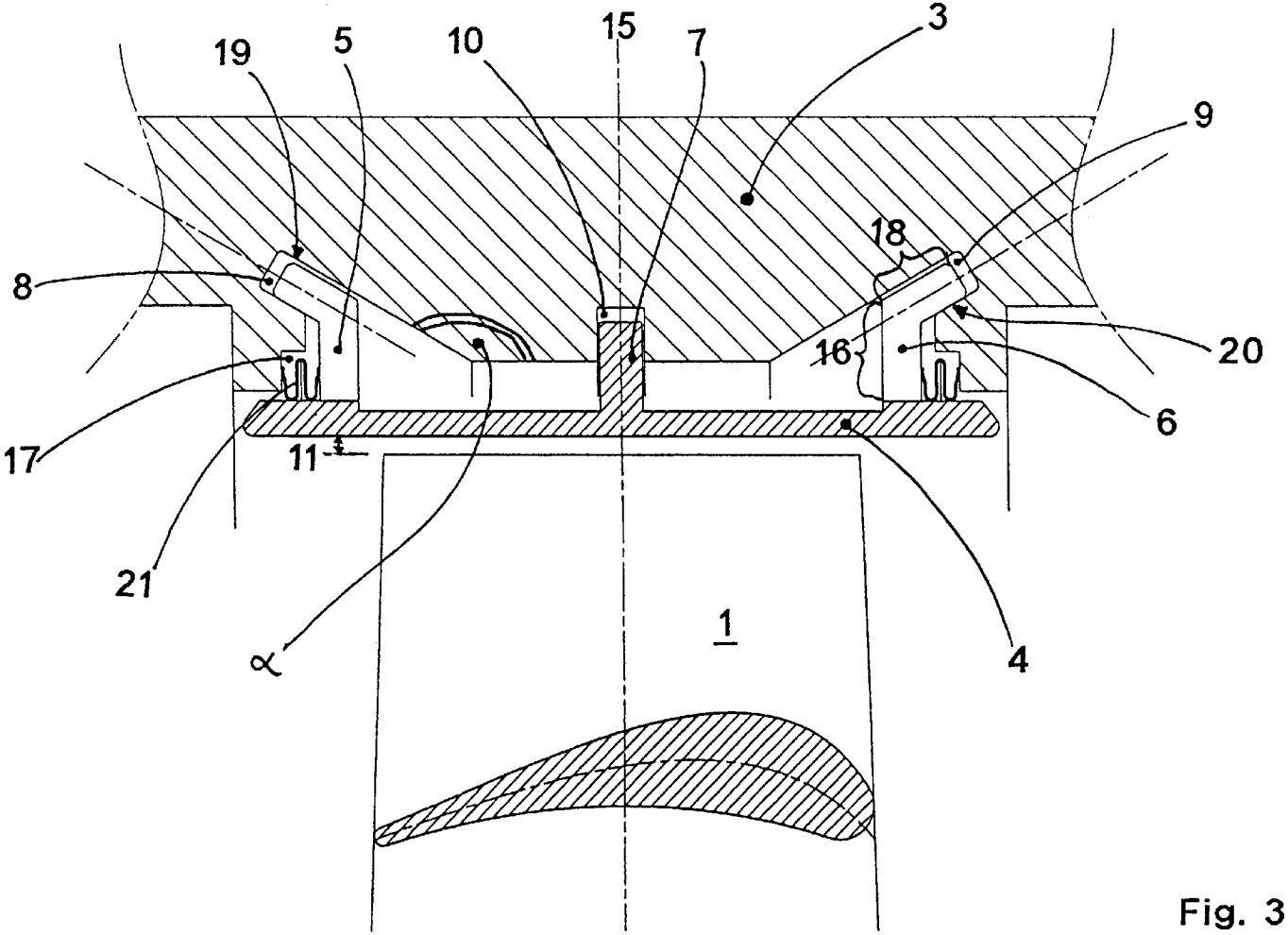
Figure 4:
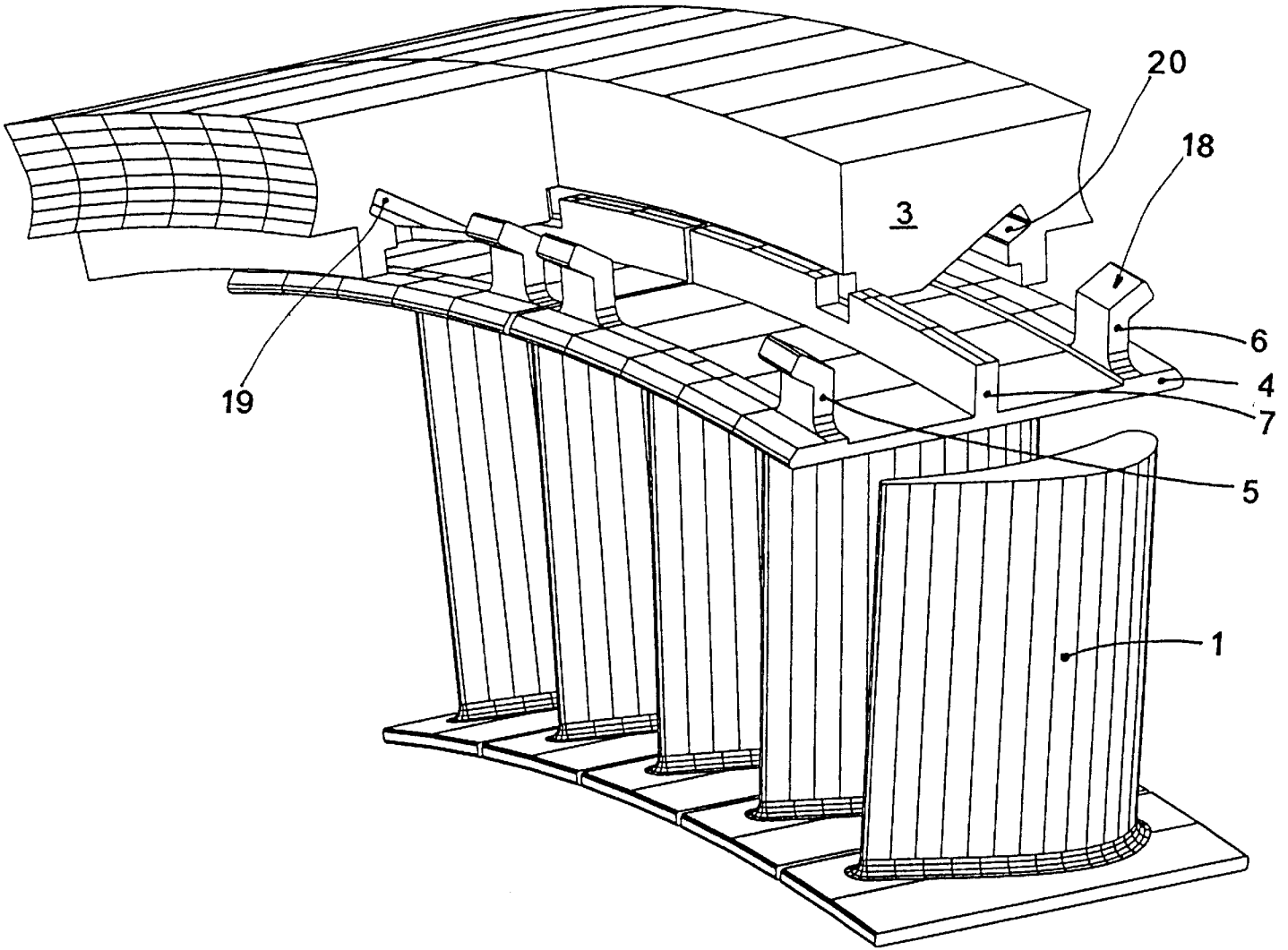

The invention is described below by way of example, without the general idea of the invention being restricted, by means of exemplary embodiments, with reference to the drawing in which:

FIG. 1 shows a diagrammatic illustration in longitudinal section through part of a rotor arrangement and stator arrangement with automatic gap width setting, FIG. 2 shows a triangular relationship to explain the positive displacement, FIG. 3 shows an average exemplary embodiment, and FIG. 4 shows a three-dimensional orientation.

DETAILED DESCRIPTION OF THE PREFERRED EMBODIMENTS

The exemplary embodiment of a rotor arrangement and stator arrangement, illustrated in FIG. 1 in a diagrammatic longitudinal section, shows four moving blades 1 which are located with their moving blade ends opposite a stator arrangement 2. The stator arrangement 2 has a stator carrier 3, which generally also constitutes the stator housing, and stator segments 4, which in each case are operatively connected to the stator carrier 3 via holding webs 5, 6 and 7 in appropriately corresponding countercontours 8, 9, 10. Each stator segment 4 is arranged opposite, and spaced from, the moving blade 1 and with the latter encloses the gap 11 which it is expedient to limit to the smallest possible gap dimension.

The rotor arrangement 1 and stator arrangement 2 illustrated in FIG. 1 shows a longitudinal section through a rotary machine arranged essentially symmetrically to the axis of rotation 12. Thus, the stator carrier 3 completely surrounds the rotor arrangement 1 angularly, there being arranged next to one another, on the inside of the stator carrier 3, a multiplicity of stator segments 2 for each moving blade row, which are connected to the stator carrier 3 in the way specified.

In the exemplary embodiment according to FIG. 1, each individual stator segment 4 arranged in each case opposite a moving blade row has a sheet-like portion 12, one top side 13 of which is located opposite the moving blades 1 and the other top side 14 of which faces the stator carrier 3. Provided on the top side 14 of the stator segment 4 are holding webs 5, 6 and 7, the holding webs 5 and 6 of which are formed mirror-symmetrically with respect to the center axis of symmetry 15. The holding web 7 serves as a securing web and projects with its rectilinearly shaped contour into a corresponding shaped countercontour 10 in the stator carrier. The holding web 7 serves as an axial reference for the stator segment 4 or for the possible expansions or movements of the other holding webs. The holding webs 5, 6 each have a portion 16 which directly ascends vertically from the top side 14 of the stator segment 4 and which penetrates into a recess 17 within the stator carrier 3. Inclined at an angle $\alpha$ which is preferably dimensioned larger than 0° and smaller than 90°, and for the abovementioned reasons may also be between 90° and 180°, preferably, for technical reasons, measures between 10° and 45°, and which relates to an imaginary axial reference line which, in the exemplary embodiment runs tangential to the inside of the stator carrier 3 and also parallel to the longitudinal extent of the sheet-like portion of the stator segment 12, a holding web portion 18 running at an inclination adjoins the holding web portion 16 and terminates on one side. The countercontour 8, 9 in each case has two obliquely running faces 19, 20, along which the holding web 18 is positively guided with its outer contour. The two ends of the holding web portions 18 of the holding webs 5, 6 are arranged so as in each case to be directed toward one another.

For reasons of symmetrical centering of the stator segment 4 relative to a center axis of symmetry through the holding web 7, expandable sealing elements 21 are provided (see FIG. 3) in the recesses 17 on both sides, said sealing elements being manufactured from a heat-resistant elastomer or from a spring element and serving for sealing off the stator segment relative to the carrier.

By the stator segment being designed according to the invention and being arranged within the stator carrier, then, it is possible to utilize the material expansion effects taking place during heating, in such a way that the gap dimension s of the gap 11 can be kept at the smallest possible value under essentially all thermal and operating conditions, but, above all, when the turbomachine is in the normal operating state.

During the increase in temperature within the turbomachine, the sheet-like stator segment 4 expands, particularly in the sheet-like portion 12. The longitudinal expansion of the stator segment 4 takes place symmetrically to the centrally arranged holding or securing web 7 which projects into the countercontour 10 of the stator carrier 3 moveably in the radial direction. Due to the elongation of the stator segment 4 relative to the stator carrier 3, the two holding webs 5, 6 are driven outward. On account of the inclination of the holding web portions 18 and their positive guidance along the obliquely running faces 19, 20, the entire stator segment 4 is moved in the radial direction in the direction of the moving blade end. The gap dimension s is thereby reduced in spite of heating within the turbomachine.

During the heating of the rotor arrangement and stator arrangement, the stator segment 4 undergoes higher and faster heating than the stator carrier 3 located radially behind the stator segment 4, especially since said stator carrier is thermally protected by the stator segment 4. The resulting relative movement between the two components 3, 4 depends essentially on the temperature difference and the coefficients of thermal expansion of the selected materials. A parameter which is responsible for the extent of positive radial displacement of the stator segment 4 and which leads to the reduction in the gap is the axial expansion b of the surface region 12 of the stator segment 2 between the two holding webs 5, 6. When the stator segment 2 expands relative to the carrier 3, the increase in the spacing b between the holding webs 5, 6 determines the positive displacement in the radial direction, occurring as a result of the angle of inclination $\alpha$ of the holding web portion 18. The inclination $\alpha$ of the holding web defines the radial displacement of the stator segment in the way which may be gathered from the geometric relationship in FIG. 2.

A right-angled triangle can be seen in FIG. 2, the adjacent side of which corresponds to the amount of relative longitudinal expansion $\Delta b$ and the opposite side of which corresponds to the positive radial displacement $\Delta s$ (gap reduction). The angle $\alpha$ is formed by the hypotenuse and the adjacent side. The angle $\alpha$ thus defines the radial displacement of the stator segment which is directed counter to the expansion of the annular stator carrier and consequently to the increase in the gap relative to the moving blade.

FIG. 3 illustrates a further exemplary embodiment, given reference symbols already introduced, for the significance of which reference is made to the exemplary embodiment according to FIG. 1. In contrast to FIG. 1, the inclined holding web portions 18 of the holding webs 5, 6 have an angle $\alpha$ larger by 90°. This angular configuration is selected in those cases where the stator carrier 3 expands due to the action of heat more quickly than the stator segment 4, at least during the transient operating behavior of the gas turbine. When the gas turbine reaches its normal operating state, a reduction in the gap width 11 is likewise achieved by means of the selected angle setting in the range between 90° and 180°.

Expandable sealing elements 21 may also be gathered from the exemplary embodiment according to FIG. 3 which serve for sealing off the holding webs relative to the stator carrier 3. They are provided between the holding webs 5, 6 and a recess 17 within the stator carrier 3. In the example shown, the seals 21 are designed as spring elements, but thermally resistant elastomeric sealing elements may also be used.

FIG. 4 illustrates the three-dimensional orientation of the mode of connection between the stator segments 4 and the stator carrier 3. Attention is drawn to the reference symbols already introduced.

In principle, other exemplary embodiments may also be envisaged, providing two holding webs, only one of which is designed in the same way as or in a similar way to the holding webs 5, 6 in the exemplary embodiment according to FIG. 1. The second holding web could be produced merely as a securing web and serve as an abutment for appropriately supporting the force which occurs as a result of the longitudinal expansion of the stator segment. In the exemplary embodiment according to FIG. 1, the holding webs 5, 6 are arranged one behind the other in the axial direction of the turbomachine. It is also conceivable, in principle, to arrange the holding webs axially parallel in the stator carrier, that is to say, in this case, it will be possible to insert the holding webs of the stator segments into the stator carrier not in the circumferential direction in relation to the stator carrier, but in the axially parallel direction.

The surface contours of the stator carrier 3, of the stator segment 4 and of the moving blade ends may also be designed in any desired way and be adapted to one another. The essential factor is that at least one holding web has at least one holding web portion which is inclined at the angle $\alpha$, the angle $\alpha$ being formed by the direction of the longitudinal extent of the inclined holding web portion and a plane which contains the axis of rotation R and which at the same time is oriented perpendicularly to the radial longitudinal extent of that moving blade which encloses the gap 11.

I claim:

1. A device for the controlled setting of a radial gap between a rotor arrangement and an annular array of circumferentially surrounding shroud assemblies in a turbomachine, wherein the shroud assemblies include a shroud carrier and at least one shroud segment connectable to the shroud carrier via at least two holding webs, wherein the two holding webs are spaced from one another on the shroud segment and engage at least partially into countercounters within the shroud carrier;

wherein the rotor arrangement including at least one row of radially outwardly extending rotor blades rotatable about an axis of rotation, such that the radial gap is formed between the ends of the rotor blades and the shroud segments without external drive means;

wherein at least one holding web portion engaging at least partially into countercontours within the shroud carrier wherein said inclined holding web portion is inclined at an angle $\alpha$ relative a tangent line, tangent to an inner surface of said shroud carrier at a point approximately where said at least one holding web intersects said inner surface of said shroud carrier, and wherein $0° < \alpha < 90°$ or $90° < \alpha < 180°$;

wherein the at least one holding web is mounted so as to be moveable relative to the shroud carrier within the countercontour of the shroud carrier as a result of longitudinal thermal expansion of the shroud segment, thereby moving the inclined holding web portion along the countercontour of the shroud carrier and reducing the gap.

2. The device as claimed in claim 1, wherein the two holding webs are designed and arranged mirror-symmetrically to an imaginary center axis of symmetry running through the shroud segment.

3. The device as claimed in claim 1, wherein the holding webs are mounted so as to be moveable relative to the shroud carrier within the countercontours as a result of the thermal expansion of the entire shroud segment, in particular as a result of the thermal expansion of that region of the shroud segment which is located between the two holding webs.

4. The device as claimed in claim 1, wherein the inclined holding web portion is a freely terminating end portion of the holding web.

5. The device as claimed in claim 4, wherein the inclined holding web portion is oriented relative to the shroud segment in such a way that the loose end of the holding web faces the other holding web or the ends of the two holding webs face away from one another.

6. The device as claimed in claim 1, wherein the shroud segment has a surface facing the rotor arrangement and a surface facing away from said rotor arrangement, by means of which surfaces the shroud carrier is thermally shielded relative to the rotor arrangement, and in that the holding webs are mounted on the surface facing away from the rotor arrangement.

7. The device as claimed in claim 6, wherein the holding web has a vertical portion which emanates from the surface facing away from the rotor arrangement and which merges via a bent region into the inclined holding web portion.

8. The device as claimed in claim 7, wherein the longitudinal extents of the vertical and inclined holding web portions form the angle $\alpha+90°$.

9. The device as claimed in claim 7, wherein an elastic sealing element is introduced into a recess of the shroud carrier into which the vertical portion projects.

10. The device as claimed in claim 2, wherein a securing web is provided centrally between two mirror-symmetrically designed holding webs, said securing web projecting vertically into the shroud carrier and being moveable relative to the latter in the radial direction toward the rotor arrangement.

11. The device as claimed in claim 1, wherein the material of the shroud carrier and of the shroud segment have different temperature coefficients and/or coefficients of thermal expansion.

12. A method for the controlled setting of the gap between a shroud arrangement and a rotor arrangement of a turbomachine, the shroud arrangement having a shroud carrier and at least one shroud segment connectable to the shroud carrier via at least two holding webs and the rotor arrangement providing at least one moving blade row rotatable about an axis of rotation and having a plurality of individual moving blades, the positioning of the moving blade ends are opposite the shroud element and with the latter enclose a radial gap, wherein the heat causes the elongation of the shroud segment giving rise, by means of the positive guidance of the holding webs within the shroud carrier, to a radial displacement in position of the entire shroud segment in the direction of the rotor arrangement.

13. The method as claimed in claim 12, wherein, due to the positive guidance of the holding webs within the shroud carrier in each case along a face inclined at an angle $0°<\alpha<90°$ or $90°<\alpha<180°$ relative to the direction of elongation, the thermally induced elongation of the shroud segment is converted into a translational movement of the entire shroud segment relating to the shroud carrier, said translational movement running essentially orthogonally to the direction of elongation.

14. A device for the controlled setting of a radial gap between a rotor arrangement and an annular array of circumferentially surrounding shroud assemblies in a turbomachine, wherein the shroud assemblies include a shroud carrier and at least one shroud segment connectable to the shroud carrier via at least two holding webs, wherein the two holding webs are spaced from one another on the shroud segment and engage at least partially into countercounters within the shroud carrier;

wherein including at least one row of radially outwardly extending rotor blades rotatable about an axis of rotation, such that the radial gap is formed between the ends of the rotor blades and the shroud segments without external drive means;

wherein at least one holding web portion engaging at least partially into countercontours within the shroud carrier wherein said inclined holding web portion is inclined at an angle a relative a tangent line, tangent to an inner surface of said shroud carrier at a point approximately where said at least one holding web intersects said inner surface of said shroud carrier, and wherein $0°<\alpha<90°$ or $90°<\alpha<180°$;

wherein a securing web is provided centrally between two mirror-symmetrically designed holding webs, said securing web projecting vertically into the shroud carrier and being moveable relative to the latter in the radial direction toward the rotor arrangement.

* * * * *